US012486681B2

(12) United States Patent
Yao et al.

(10) Patent No.: US 12,486,681 B2
(45) Date of Patent: Dec. 2, 2025

(54) PREFABRICATED LAMINATED SLAB MADE IN ACCORDANCE WITH PRETENSIONING FIBERMESH ANTI-CRACKING PROCESS AND MANUFACTURING METHOD THEREOF

(71) Applicants: The Construction Engineering Company of CTCE Group, Hefei (CN); CHINA TIESIJU CIVIL ENGINEERING GROUP CO., LTD, Hefei (CN); CHANG'AN UNIVERSITY, Xi'an (CN)

(72) Inventors: Dongfang Yao, Anhui (CN); Chaoming Yu, Anhui (CN); Zonglu Yang, Anhui (CN); Xiaowen Chen, Anhui (CN); Huying Ding, Anhui (CN); Kui Liu, Anhui (CN); Tao Wu, Anhui (CN); Xi Liu, Anhui (CN); Chaoqian Lv, Anhui (CN); Houliang Wen, Anhui (CN); Yuan Gao, Anhui (CN); Xiaoguang Ma, Anhui (CN); Guangyu Yang, Anhui (CN); Yan Hao, Anhui (CN); Yongli Liu, Anhui (CN)

(73) Assignees: THE CONSTRUCTION ENGINEERING COMPANY OF CTCE GROUP, Hefei (CN); CHINA TIESIJU CIVIL ENGINEERING GROUP CO., LTD, Hefei (CN); CHANG'AN UNIVERSITY, Xi'an (CN)

( * ) Notice: Subject to any disclaimer, the term of this patent is extended or adjusted under 35 U.S.C. 154(b) by 0 days.

(21) Appl. No.: 18/022,615

(22) PCT Filed: Sep. 30, 2022

(86) PCT No.: PCT/CN2022/123258

§ 371 (c)(1),
(2) Date: Feb. 22, 2023

(87) PCT Pub. No.: WO2024/065670

PCT Pub. Date: Apr. 4, 2024

(65) Prior Publication Data

US 2024/0271437 A1 Aug. 15, 2024

(51) Int. Cl.
*E04G 21/12* (2006.01)
*E04C 2/06* (2006.01)

(52) U.S. Cl.
CPC ..... *E04G 21/12* (2013.01); *E04C 2/06* (2013.01)

(58) Field of Classification Search
CPC ... E04G 21/12; E04C 2/06; E04C 2/00; E04C 2/26; E04C 5/08; E04B 5/02
See application file for complete search history.

(56) References Cited

U.S. PATENT DOCUMENTS 6,385,930 B1 * 5/2002 Broms ..... E04B 5/43 52/223.6
2023/0349155 A1 * 11/2023 Zhang ..... E04C 5/08

FOREIGN PATENT DOCUMENTS

CN 208545875 U * 2/2019
CN 110524679 A * 12/2019
(Continued)

*Primary Examiner* — Rodney Mintz

(57) ABSTRACT

Disclosed is a prefabricated laminated slab made in accordance with a pretensioning fibermesh anti-cracking process and a manufacturing method thereof, and belongs to the technical field of fabricated structure engineering. The prefabricated laminated slab comprises a concrete layer, fiber grids, distribution bars and truss bars. The fiber grids are subjected to prestress tensioning and pouring to form a novel laminated slab with the pretensioning process, an overall pouring process of layered formworks is adopted, the construction problem during prestress tensioning of the fiber
(Continued)

grids of the component can be effectively solved, the crack resistance of the laminated slab can be improved by adopting the prestress grids, the rigidity is increased, and the crack width under normal use conditions is reduced.

2 Claims, 3 Drawing Sheets

(56) References Cited

FOREIGN PATENT DOCUMENTS

| | | | | | |
|---|---|---|---|---|---|
| CN | 111794519 | A | * | 10/2020 | ..... E04C 5/12 |
| CN | 113089928 | A | * | 7/2021 | ..... B28B 1/045 |
| CN | 217353122 | U | * | 9/2022 | |
| WO | WO-2019135719 | A1 | * | 7/2019 | |

* cited by examiner

PREFABRICATED LAMINATED SLAB MADE IN ACCORDANCE WITH PRETENSIONING FIBERMESH ANTI-CRACKING PROCESS AND MANUFACTURING METHOD THEREOF

CROSS-REFERENCE TO RELATED APPLICATION

This application is a national stage application filed pursuant to 35 U.S.C. § 371 of International Application No. PCT/CN2022/123258, which was filed on Sep. 30, 2022. The entire contents of this latter application is hereby incorporated by reference.

TECHNICAL FIELD

The present disclosure relates to the technical field of fabricated structure engineering, in particular to a prefabricated laminated slab with a pretensioning fibermesh anti-cracking process and a manufacturing method thereof.

BACKGROUND ART

At present, a large number of concrete prefabricated laminated slabs used in fabricated buildings often generate cracks due to collision and unfavorable bending moment in the transportation, hoisting and stacking processes, even fracture is induced, and unnecessary economic damage and construction period delay are caused. In practice, only the positions of lifting hooks of the laminated slab are changed, or the slab span is reduced in design to reduce the cracking probability, and the problems of brittleness and easy cracking are not fundamentally solved.

Fiber materials have the advantages of light weight, high tensile strength, good corrosion resistance and the like. The anti-cracking performance of concrete slabs can be improved by doping fibers into concrete. However, researches find that the problems of fiber agglomeration, slurry cavities and the like often exist when the fibers are dispersed in the concrete only through mechanical stirring, the working efficiency of the fibers is only 40%-70%, and the performance of the fibers cannot be fully exerted.

In order to solve the problem that the laminated slab is easy to crack and improve the working efficiency of fibers, the fiber knitmesh after prestress tensioning is added into the concrete laminated slab. The component has good bearing capacity, are higher in durability and crack resistance, can effectively save resources and reduce waste, and accord with the advanced concept of "green buildings".

SUMMARY

The present disclosure aims to overcome the defects, and provides a prefabricated laminated slab with a pretensioning fibermesh anti-cracking process and a manufacturing method thereof. The prefabricated laminated slab is simple in structure and reasonable in design, so that the durability and anti-cracking capability of components are improved, resources are effectively saved, wastes are reduced, and the advanced concept of green buildings is achieved.

To solve the technical problems, the following technical schemes are used in the present disclosure.

A prefabricated laminated slab with a pretensioning fibermesh anti-cracking process comprises fiber grids, wherein a concrete layer is arranged above the fiber grids, and the concrete layer is internally provided with distribution bars and truss bars.

Further, the fiber grids are orthogonal grids with overhanging fiber whiskers, and the bore diameter of the grid is 20 mm (0.788 inch) to 50 mm (1.97 inch), and the fiber grid is tensioned with a pretensioning method before concrete is poured.

Furthermore, the thickness of the concrete layer is 60 mm (2.364 inch) to 120 mm (4.728 inch), and the particle size of concrete aggregate adopted by the concrete layer is smaller than the pore diameter of the fiber grid.

Furthermore, the distribution bars comprise longitudinal distribution bars and transverse distribution bars, and the longitudinal distribution bars and the transverse distribution bars are all located above the fiber grids.

Furthermore, the truss bars comprise two bottom longitudinal bars, top longitudinal bars and a plurality of connecting bars, the two bottom longitudinal bars are located between the longitudinal distribution bars, the top longitudinal bars are located above the concrete layer, and the two ends of the connecting bars are respectively connected with the bottom longitudinal bars and the top longitudinal bars.

A manufacturing method of the prefabricated laminated slab with a pretensioning fibermesh anti-cracking process comprises the following steps:

- step one, mounting formworks, the formworks comprising two long-edge side formworks, a whole bottom formwork, two layered detachable slotted side plates capable of penetrating through a fibermesh, rubber strips for sealing gaps and side plate bolts, mounting the side formworks on the two sides of the bottom formwork, and mounting lower parts of the layered detachable slotted side plates on the other two sides of the bottom formwork;
- step two, placing fiber grids in channels of the layered detachable slotted side plates, and mounting the upper parts of the layered detachable slotted side plates;
- step three, mounting a stretching bed, the stretching bed comprising a rectangular stretching steel rod, a pretension control bolt, a pressure sensor located at the counter-force end and a bolt pin anchor which is special for the fibermesh and located on the other sides of the formworks, fixing one end of the fiber grid through the bolt pin anchor and fixing the other end of the fiber grid to the stretching steel rod, stretching the fiber grids with the pretension control bolt, using a pressure sensor at the counter-force end to complete tension control, and tightening the side plate bolts to compact reserved seams of the side plates;
- step four, distributing and placing distribution bars and truss bars above the fiber grids, and controlling the height positions of the bars through concrete cushion blocks;
- step five, completing concrete pouring in the formworks, and carrying out full vibration; and
- step six, carrying out regular maintenance, after the strength meets the requirement, removing the stretching bed and the formworks to complete the manufacturing of the prefabricated laminated slab with a pretensioning fibermesh anti-cracking process.

Compared with the prior art, the present disclosure has the following beneficial effects.

The prefabricated laminated slab is simple in structure, reasonable in design, easy to manufacture, assemble and disassemble and low in cost. By using large-aperture orthogonal grids with overhanging fiber whiskers and an aggregate particle size control method, the problem that the concrete of a slab body is cut by a fibermesh is effectively solved, the layering effect is weakened, and the performance of the laminated slab is improved. The problem that fiber grid stretching construction is difficult to manufacture is effectively solved by adopting a reasonable tension control device and a stretching device which is detachably connected with an upper formwork and a lower formwork and is low in cost and easy to operate. Pretensioning fiber grids are arranged at the bottom of the prefabricated laminated slab, so that cracks generated by collision and unfavorable bending moment in the transportation, hoisting and stacking processes of the laminated slab can be effectively improved. Moreover, the deflection and crack width of the laminated slab in the normal use process can be reduced, the impact resistance of the material is improved, and the prefabricated laminated slab plays a positive role in protecting the ecological environment and promoting the development of fabricated buildings.

BRIEF DESCRIPTION OF THE DRAWINGS

The following describes the present disclosure in detail with reference to the following attached figures.

Reference signs: 1, concrete layer; 2, fiber grid; 3, distribution bar; 4, truss bar; 5, formwork; 31, longitudinal distribution bar; 32, transverse distribution bar; 41, bottom longitudinal bar; 42, top longitudinal bar; 43, connecting bar; 51, side formwork; 52, bottom formwork; 53, layered detachable slotted side plate; 54, rubber strip; 55, side plate bolt; 6, stretching bed; 61, stretching steel rod; 62, pretension control bolt; 63, pressure sensor; and 64, bolt pin anchor.

DETAILED DESCRIPTION OF THE EMBODIMENTS

Figure 1:
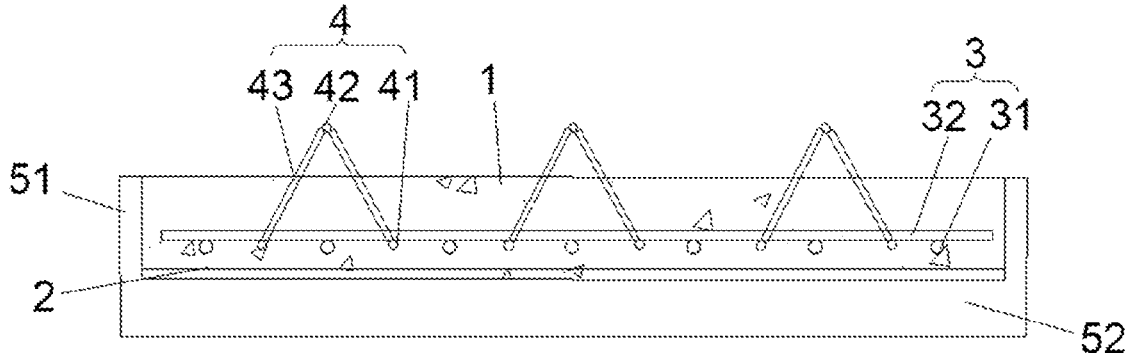
FIG. 1 is a front view profile of a prefabricated laminated slab with a pretensioning fibermesh anti-cracking process in the present disclosure.
Figure 2:
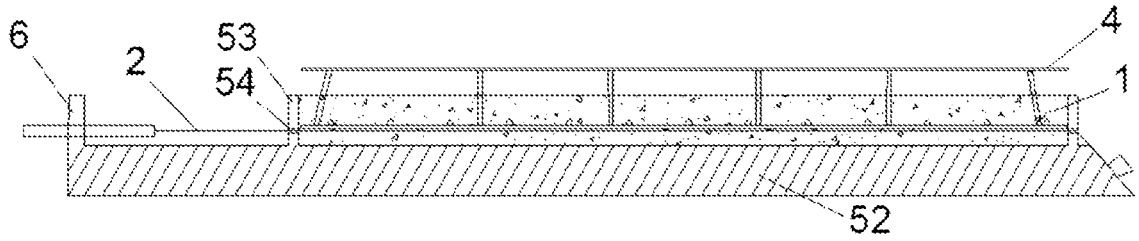
FIG. 2 is a side view profile of a prefabricated laminated slab with a pretensioning fibermesh anti-cracking process in the present disclosure.
Figure 3:
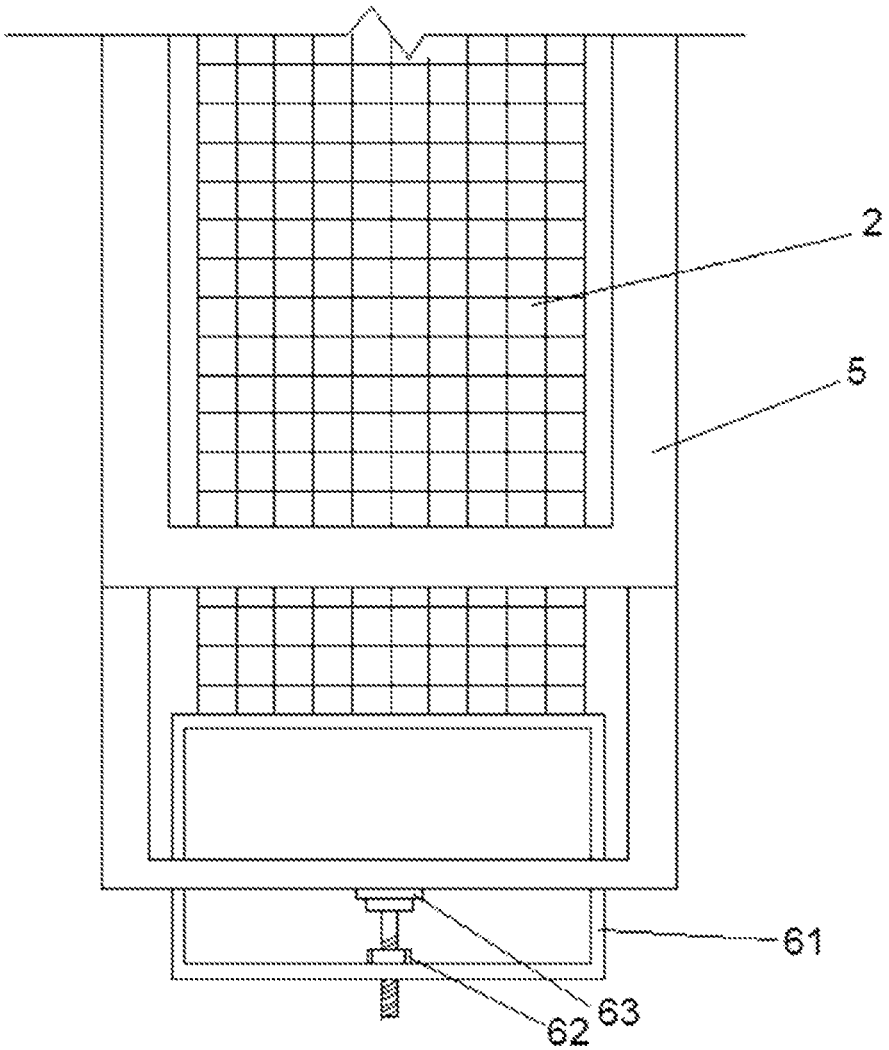
FIG. 3 is a top view of a stretching bed in the present disclosure.
Figure 4:
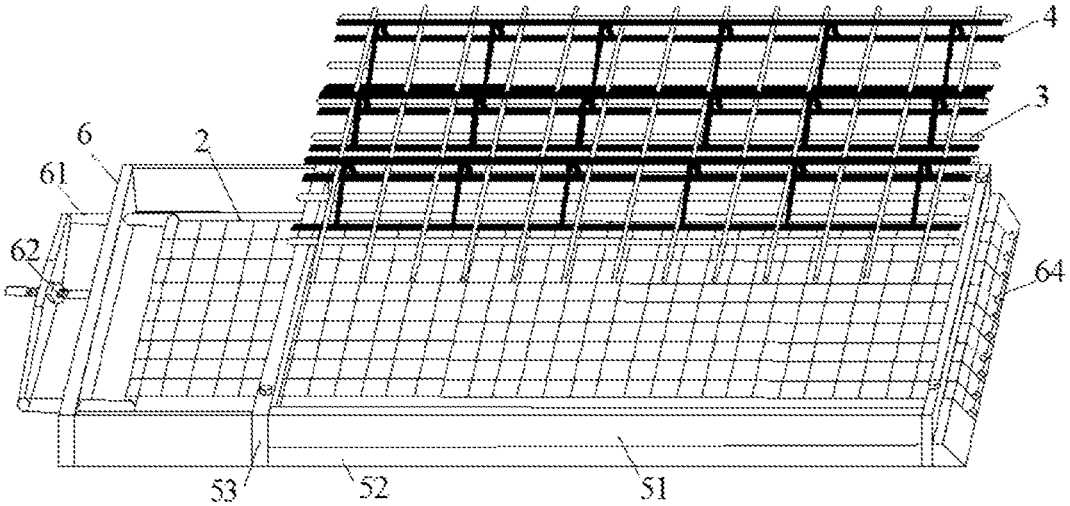
FIG. 4 is a space diagram of a stretching bed in the present disclosure.
Figure 5:
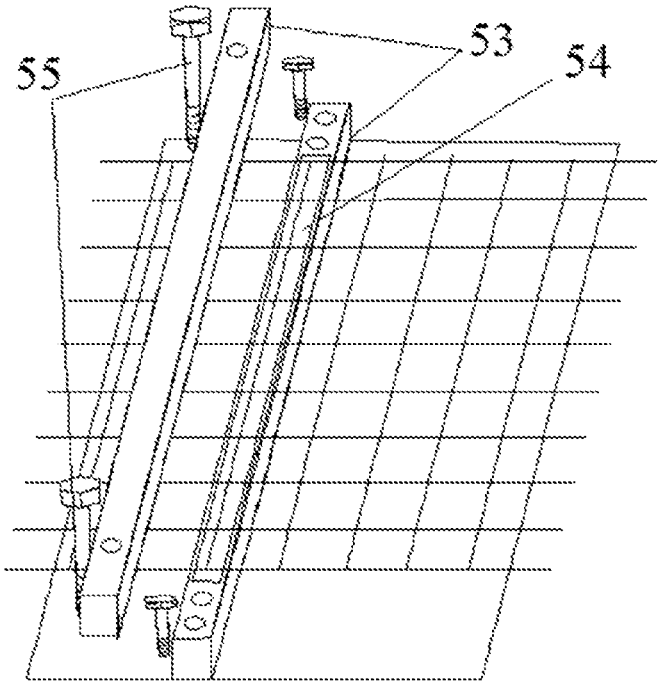
FIG. 5 is a structural schematic diagram of layered detachable slotted side plates in the present disclosure.

As shown in FIG. 1 to FIG. 5, a prefabricated laminated slab with a pretensioning fibermesh anti-cracking process comprises fiber grids 2, wherein a concrete layer 1 is arranged above the fiber grids 2, and the concrete layer is internally provided with distribution bars 3 and truss bars 4.

Specifically, the thickness of the concrete layer 1 is 60 mm (2.364 inch) to 120 mm (4.728 inch), and the fiber grids 2 are orthogonal grids with overhanging fiber whiskers, so that the adhesive property of the grids is improved, and the problem of concrete layering caused by the fiber grids is solved. The bore diameter of the grid is 20 mm (0.788 inch) to 50 mm (1.97 inch) and is required to be larger than the particle size of concrete aggregate, so that the aggregate can conveniently penetrate through the grids, the uniformity of the aggregate in the slab is improved, the shrinkage resistance of a protective layer at the bottom of the slab is improved, and the shrinkage cracking probability of the prefabricated slab is reduced. The fiber grid 2 is made of GFRP, CFRP, AFRP, BFRP and other materials, and the fiber grid 2 is tensioned with a pretensioning method before concrete is poured.

The thickness of the concrete layer 1 is 60 mm (2.364 inch) to 120 mm (4.728 inch), and the particle size of concrete aggregate adopted by the concrete layer 1 is smaller than the pore diameter of the fiber grid 2.

The distribution bars 3 comprise longitudinal distribution bars 31 and transverse distribution bars 32, and the longitudinal distribution bars 31 and the transverse distribution bars 32 are all located above the fiber grids 2.

The truss bars 4 comprise two bottom longitudinal bars 41, top longitudinal bars 42 and a plurality of connecting bars 43, the two bottom longitudinal bars 41 are located between the longitudinal distribution bars 31, the top longitudinal bars 42 are located above the concrete layer 1, and the two ends of the connecting bars 43 are respectively connected with the bottom longitudinal bars 41 and the top longitudinal bars 42.

A manufacturing method of the prefabricated laminated slab with a pretensioning fibermesh anti-cracking process comprises the following steps:

- step one, mounting formworks 5, the formworks 5 comprising two long-edge side formworks 51, a whole bottom formwork 52, two layered detachable slotted side plates 53 capable of penetrating through a fibermesh, rubber strips 54 for sealing gaps and side plate bolts 55, mounting the side formworks 51 on the two sides of the bottom formwork 52, and mounting lower parts of the layered detachable slotted side plates 53 on the other two sides of the bottom formwork 52;
- step two, placing fiber grids 2 in channels of the layered detachable slotted side plates 53, and mounting the upper parts of the layered detachable slotted side plates 53;
- step three, mounting a stretching bed 6, the stretching bed 6 comprising a rectangular stretching steel rod 61, a pretension control bolt 62, a pressure sensor 63 located at the counter-force end and a bolt pin anchor 64 which is special for the fibermesh and located on the other sides of the formworks 5, fixing one end of the fiber grid 2 through the bolt pin anchor 64 and fixing the other end of the fiber grid 2 to the stretching steel rod 61, stretching the fiber grids 2 with the pretension control bolt 62, using a pressure sensor 63 at the counter-force end to complete tension control, and tightening the side plate bolts 55 to compact reserved seams of the side plates;
- step four, distributing and placing distribution bars 3 and truss bars 4 above the fiber grids 2, and controlling the height positions of the bars through concrete cushion blocks;
- step five, completing concrete pouring in the formworks 5, and carrying out full vibration; and
- step six, carrying out regular maintenance, after the strength meets the requirement, removing the stretching bed 6 and the formworks 5 to complete the manufacturing of the prefabricated laminated slab with a pretensioning fibermesh anti-cracking process.

Specifically, the whole stretching process of the pretension control bolt can suffer from pressure but cannot suffer from tension. The process is more accurate and economical by using the pressure sensor. The compressive reaction force of the pretension control bolt is used for driving the stretching steel rod to complete tensioning.

In the third step, the stretching steel rod penetrates through the stretching bed, bed holes are used for restraining the angle of the stretching steel rod, eccentric loading cannot occur in the stretching process, and the process is more stable.

The upper and lower layered detachable slotted side plates are connected through bolts to design the layered detachable slotted side plates, so that laying and positioning of the fiber grids every time are facilitated. The process is high in repeated utilization rate, green and efficient, and is suitable for industrially producing laminated slabs in prefabricated factory buildings. The height of the fibermesh is controlled by using a slotting design of the detachable slotted side plates, and the position of each bundle of fibers is controlled by using the bolt pin anchor, so that the process is more convenient and efficient and is less disturbed.

The embodiments described above only describe the preferred manner of the present disclosure and do not limit the scope of the present disclosure, and various modifications and improvements made to the technical solution of the present disclosure by those skilled in the art will fall within the scope of protection as determined by the claims of the present disclosure without departing from the spirit of the design of the present disclosure.

What is claimed is:

1. A prefabricated laminated slab made in accordance with a pretensioning fibermesh anti-cracking process, the laminated slab comprising:

fiber grids, wherein a concrete layer is arranged above the fiber grids, and the concrete layer is internally provided with distribution bars and truss bars;

wherein the fiber grids are orthogonal grids with overhanging fiber whiskers, a fiber mesh size defining a respective pore diameter of the grids is 20 mm (0.788 inch) to 50 mm (1.97 inch), and each fiber grid is a tensioned grid;

wherein a thickness of the concrete layer is 60 mm (2.364 inch) to 120 mm (4.728 inch), and a particle size of concrete aggregate located in the concrete layer is smaller than the pore diameter of each fiber grid;

wherein the distribution bars comprise longitudinal distribution bars and transverse distribution bars, and the longitudinal distribution bars and the transverse distribution bars are all located above the fiber grids; and wherein the truss bars comprise two bottom longitudinal bars, top longitudinal bars and a plurality of connecting bars, the two bottom longitudinal bars are located between the longitudinal distribution bars, the top longitudinal bars are located above the concrete layer, and two ends of the connecting bars are respectively connected with the bottom longitudinal bars and the top longitudinal bars.

2. A manufacturing method of a prefabricated laminated slab, comprising the following steps:

providing the laminated slab according to claim 1;

mounting formworks, the formworks comprising two long-edge side formworks, a whole bottom formwork, two layered detachable slotted side plates capable of penetrating through a fibermesh, rubber strips for sealing gaps and side plate bolts, mounting the side formworks on two sides of the bottom formwork, and mounting lower parts of the layered detachable slotted side plates on another two sides of the bottom formwork;

placing fiber grids in channels of the layered detachable slotted side plates, and mounting upper parts of the layered detachable slotted side plates;

mounting a stretching bed, the stretching bed comprising a rectangular stretching steel rod, a pretension control bolt, a pressure sensor located at a counter-force end and a bolt pin anchor for the fibermesh and located on respective sides of the formworks, fixing one end of each fiber grid through the bolt pin anchor and fixing another end of each fiber grid to the stretching steel rod, stretching the fiber grids with the pretension control bolt, using a pressure sensor at the counter-force end to complete tension control, and tightening side plate bolts to compact reserved seams of the side plates;

distributing and placing the distribution bars and the truss bars above the fiber grids, and controlling height positions of each of the bars through concrete cushion blocks;

completing concrete pouring in the formworks, and carrying out full vibration; and carrying out regular maintenance, after strength meets a requirement, removing the stretching bed and the formworks to complete manufacturing of the prefabricated laminated slab with the pretensioning fibermesh anti-cracking process.

* * * * *